US005676182A

United States Patent [19]

McMullen, Jr. et al.

[11] Patent Number: 5,676,182

[45] Date of Patent: Oct. 14, 1997

[54] PORTABLE APPARATUS AND METHOD FOR WINTERIZING OF SEASONAL DWELLINGS

[76] Inventors: George Wayne McMullen, Jr., 240 Gibb Street; David Anthony Watson, 238 Gibb Street, both of Oshawa, Canada, L1J 1Y8

[21] Appl. No.: 620,412

[22] Filed: Mar. 22, 1996

[51] Int. Cl.[6] ..... B65B 31/04

[52] U.S. Cl. ..... 141/66; 141/7; 137/240; 137/899

[58] Field of Search ..... 141/66, 67, 5, 141/7; 4/504; 137/899, 240, 15; 138/27

[56] References Cited

U.S. PATENT DOCUMENTS

| | | | |
|---|---|---|---|
| 4,154,377 | 5/1979 | Adams | 4/389 |
| 4,755,112 | 7/1988 | Houser et al. | 417/440 |
| 5,142,707 | 9/1992 | Prue | 4/222 |
| 5,488,968 | 2/1996 | Price et al. | 137/1 |
| 5,538,031 | 7/1996 | Brence et al. | 137/899 |

FOREIGN PATENT DOCUMENTS 935134 10/1973 Canada .

OTHER PUBLICATIONS

Motor Age Dec. 9, 1920 and Jul. 15, 1920.

*Primary Examiner*—Renee S. Luebke
*Assistant Examiner*—Steven O. Douglas
*Attorney, Agent, or Firm*—Huntley & Associates

[57] ABSTRACT

A method of winterizing a seasonal dwelling. The method involves replacement of water in a piping system within the dwelling with a winterizing fluid. The water inlet of the piping system of the dwelling is connected to a fluid outlet valve of a portable fluid tank. The portable fluid tank has the fluid outlet valve at a first end and a gas inlet located at a second end opposed to the first end. The portable fluid tank has the gas inlet connected to a valved source of air under pressure. Water outlets are opened within the dwelling and air is passed through the piping system. Subsequently, winterizing fluid is added to the fluid tank and then forced into the piping system. The method permits winterizing of a dwelling in a simple, rapid manner.

7 Claims, 2 Drawing Sheets

PORTABLE APPARATUS AND METHOD FOR WINTERIZING OF SEASONAL DWELLINGS

FIELD OF THE INVENTION

The present invention relates to a portable apparatus for winterizing of seasonal dwellings, in which water within piping systems of the dwellings is replaced with a winterizing fluid, and to a method of winterizing seasonal dwellings using such apparatus. The apparatus is particularly intended for use with cottages, trailers and other dwellings that are used on a seasonal basis viz. normally spring, summer and fall, and which require winterizing by replacement of water in piping systems, including hot water tanks, toilets, showers and the like, at the end of the seasonal use and before the onset of freezing conditions.

BACKGROUND TO THE INVENTION

Many dwellings are used on a seasonal basis. Such dwellings typically include cottages and trailers which are used during months of the year in which the temperature is moderate, especially in the range of about 5°–35° C. For instance, such cottages and trailers are typically used in the months of May through October in climates that experience severe winter conditions, and need to be prepared for winter prior to the occurrence of freezing temperatures. Seasonal dwellings are usually not insulated, especially not insulated to an extent that would allow use in any period of the winter, and have limited heating systems. Thus, they are vulnerable to the effects of freezing conditions.

Cottages and trailers are normally connected to a water system. For instance, a cottage may have a water inlet pipe located within a nearby lake or may be connected to a well system for supply of water to the cottage. Trailers may obtain water from similar sources, or may obtain water from a centrally located supply within a trailer park or campground in which the trailer is located. The water is used within the cottage or trailer in toilets, for washing of dishes, ablutions, showers or for other purposes. The latter may include uses outside the cottage or trailer, for instance watering of a garden, washing of objects or recreation. Thus, a typical cottage or trailer may have a water pump supplying a water tank from which water is fed, for instance, to one or more of taps within the cottage or trailer, as well as to a toilet, a shower and a hot water tank.

In the winter, water within piping systems, toilets and other related systems e.g. any septic bed pumping tanks, will freeze. Thus, at the end of the seasonal occupation of the seasonal dwelling, it is necessary to remove water from all piping systems, including tanks, within the dwelling to prevent freezing of the water within the system. If water is allowed to remain within the piping systems, then on freezing the piping systems will crack, break or be otherwise damaged and require significant repair in the following spring.

Thus, persons who own cottages, trailers or other seasonal dwellings have a need to winterize the dwelling at the end of the season. This usually entails draining of pipes to the extent that this is possible, pouring winterizing solutions e.g. antifreeze, down toilets, showers, sinks and the like, bailing out of toilets and other vessels of that kind and feeding winterizing solutions into pumps. The latter is often done using funnels and pouring the liquid into a suitable inlet within the pump.

Alternatively, the water pipe is disconnected from the source of water. Air is blown down the water line by one person, which normally requires the assistance of a second person to open each and every valve, making sure no water is retained in the piping system. Then a garden hose is filled with antifreeze, using a funnel, with the second person opening the valves again. This procedure must be repeated several times to effect winterizing. The winterizing process is tedious, slow and requires more than one person.

Winterizing is often conducted under adverse conditions in the fall e.g. in near-freezing temperatures and often cold, wet and windy weather. It is an onerous task that must be completed with care to prevent damage to the piping systems and other water-containing vessels in or associated with the seasonal dwelling.

In some instances, particularly in trailer parks or campgrounds, it is possible to arrange for persons to winterize a trailer, for a fee. While the fee may not be particularly excessive in any one year, over a period of years the accumulated costs can be substantial. Thus, there has been a need by owners of cottages, trailers or other seasonal dwellings for a means of winterizing the water piping systems within the dwelling in a quick and efficient manner.

U.S. Pat. No. 5,142,702 of F. Prue discloses a unit for injecting a disinfectant, deodorant or the like into the inlet stream of flushing water as it is pumped into the bowl of a tankless marine toilet. A flushing cap and hose may be attached to the injection unit to introduce a cleaning or winterizing solution. Such a unit is not intended for the rapid and efficient replacement of the fluid within the entire piping system of a seasonal dwelling with a winterizing solution in the manner that could easily be adapted by owners of cottages or trailers.

SUMMARY OF THE INVENTION

A method, and apparatus, for winterizing a seasonal dwelling using a portable apparatus has been found.

Accordingly, one aspect of the present invention provides a method of winterizing a seasonal dwelling by replacement of water in a piping system within the dwelling with a winterizing fluid, said piping system having a water inlet, comprising:

(a) connecting said water inlet of said piping system of the dwelling to a fluid outlet valve of a portable fluid tank, said portable fluid tank having said fluid outlet valve at a first end thereof and a gas inlet located at a second end thereof opposed to said first end, said portable fluid tank having the gas inlet connected to a valved source of air under pressure;

(b) opening a first water outlet within said dwelling, passing air under pressure from said source of air under pressure through said portable fluid tank and from said fluid outlet thereof, through said water inlet and into the piping system until air passes from said first water outlet within said dwelling;

(c) repeating step (b) for each water outlet within said seasonal dwelling;

(d) ceasing the passing of air under pressure from said source of air and introducing winterizing fluid into said fluid tank;

(e) opening a first water outlet within said dwelling, passing further air under pressure from said source of air under pressure through said portable fluid tank and from said fluid outlet thereof, to force said winterizing fluid from said portable fluid tank into said water inlet until winterizing fluid passes from said water outlet; and (f) repeating step, (e) for each water outlet within said seasonal dwelling.

In a preferred embodiment of the invention, the air pressure in said fluid tank is less than 20 psi.

In another embodiment, the water outlets are closed in steps (b) and (e) after the respective fluid passes therefrom.

In yet another embodiment, the water outlet is a tap or valve.

A further aspect of the invention provides a portable apparatus for winterizing a seasonal dwelling by replacement of water in piping systems in the dwelling with a winterizing fluid, comprising:

(a) a fluid tank having opposed first and second ends, said first end having a gas inlet adapted to be connected to a source of air under pressure, said second end having a fluid outlet valve adapted to be connected to a water inlet of said dwelling; and (b) means to introduce a winterizing fluid into said vessel, said apparatus being capable of withstanding a pressure of at least 20 psi.

In a preferred embodiment of the apparatus of the invention, the portable fluid tank is connected to a portable source of air under pressure, said vessel with said attached source of air being portable.

BRIEF DESCRIPTION OF THE DRAWINGS

The present invention is illustrated by the embodiments shown in the drawings in which.

DETAILED DESCRIPTION OF THE INVENTION

As used herein, it is understood that the water outlet within the seasonal dwelling particularly includes taps, but may also include valves e.g. as connected to the water tank of toilets and the like.

Figure 1:
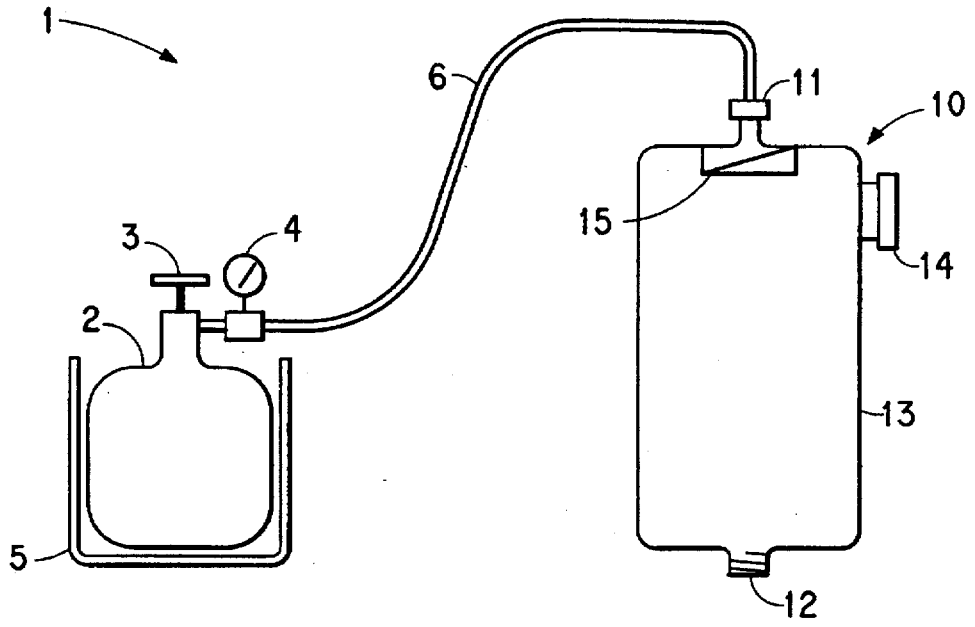
FIG. 1 is a schematic representation of a winterizing apparatus of the present invention.

FIG. 1 shows a winterizing apparatus, generally indicated by 1. Winterizing apparatus 1 has an air pressure tank 2 with valve 3 and pressure gauge 4. Air pressure tank 2, which is shown as being in tank holder 5 for protection, may be any suitable source of air under a moderate pressure, as discussed herein. It is to be understood that air pressure tank 2 may be any one of many various types of air pressure tank, or could be replaced by an air compressor or other source of compressed air. It is particularly preferred that winterizing apparatus 1 with air pressure tank 2 attached to fluid tank 10, discussed below, be portable.

Air pressure tank 2 is shown as connected to a fluid tank, generally indicated by 10, by means of air hose 6. Fluid tank 10 has air inlet 11 at one end thereof and fluid outlet 12 at the other end thereof. Air inlet 11 and fluid outlet 12 of fluid tank 10 are located at opposed ends of elongated vessel 13. Elongated vessel 13 has fluid inlet 14 located juxtaposed to air inlet 11. While fluid inlet 14 may be located at a number of locations on elongated vessel 13, it will normally be located at or near air inlet 11. Fluid inlet 14 is normally in the form of a removable cap over an inlet. It is understood that the removable cap could be on an end of elongated vessel 13, and have air inlet 11 or fluid outlet 12 therein.

In the embodiment shown, backflow valve 15 is located within elongated vessel 13 and at air inlet 11, to prevent the flow of fluid back into air hose 6. Although the apparatus of FIG. 1 is shown with backlow valve 15 e.g. a flapper valve, such a valve is not necessary and may be omitted. Fluid (air) pressure will normally prevent backflow.

In preferred embodiments, air inlet 11 has a valve, which would permit transportation of fluid tank 10 without spillage of winterizing fluid.

Figure 2:
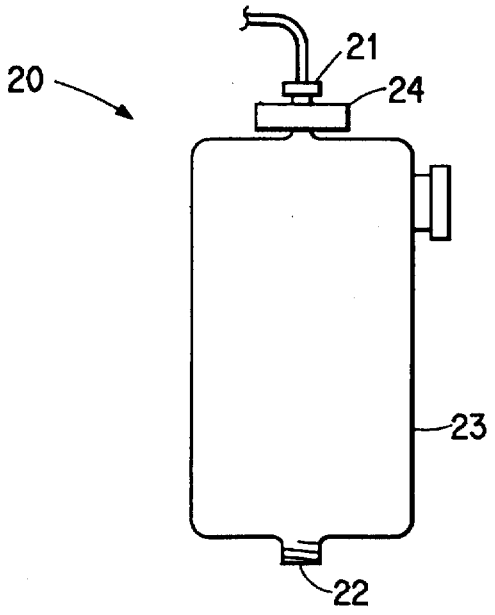
FIG. 2 is a schematic representation of a variation of the winterizing apparatus of FIG. 1.

FIG. 2 shows a variation of the elongated vessel of FIG. 1. Fluid tank 20 has air inlet 21 and fluid outlet 22 at opposed ends of elongated vessel 23. Fluid inlet 24 is shown as located between air inlet 21 and elongated vessel 23. For instance, as discussed above, fluid inlet 24 could be in the form of a removable cap to which is attached air inlet 21, and which may be unscrewed in order to add fluid into elongated vessel 23.

Air inlets 11 and 21 have been referred to as air inlets, but they may be in the form of air inlet valves. Similarly, fluid outlets 12 and 22 are shown in the drawings as being threaded outlets, but would normally be in the form of a valve, especially a valve with an associated closing mechanism that can be opened and closed as desired. Closing of fluid outlets 12 and 22 by means of a valve, enables fluid tanks 10 and 20 to be transported from one location to another while containing winterizing fluid or to be emptied at a convenient time and place. Similarly, as discussed above, air inlets 11 and 21 in the form of valves would prevent fluid within fluid tanks 10 and 20 from flowing out of such fluid tanks and would facilitate transport of fluid within such tanks.

Figure 3:
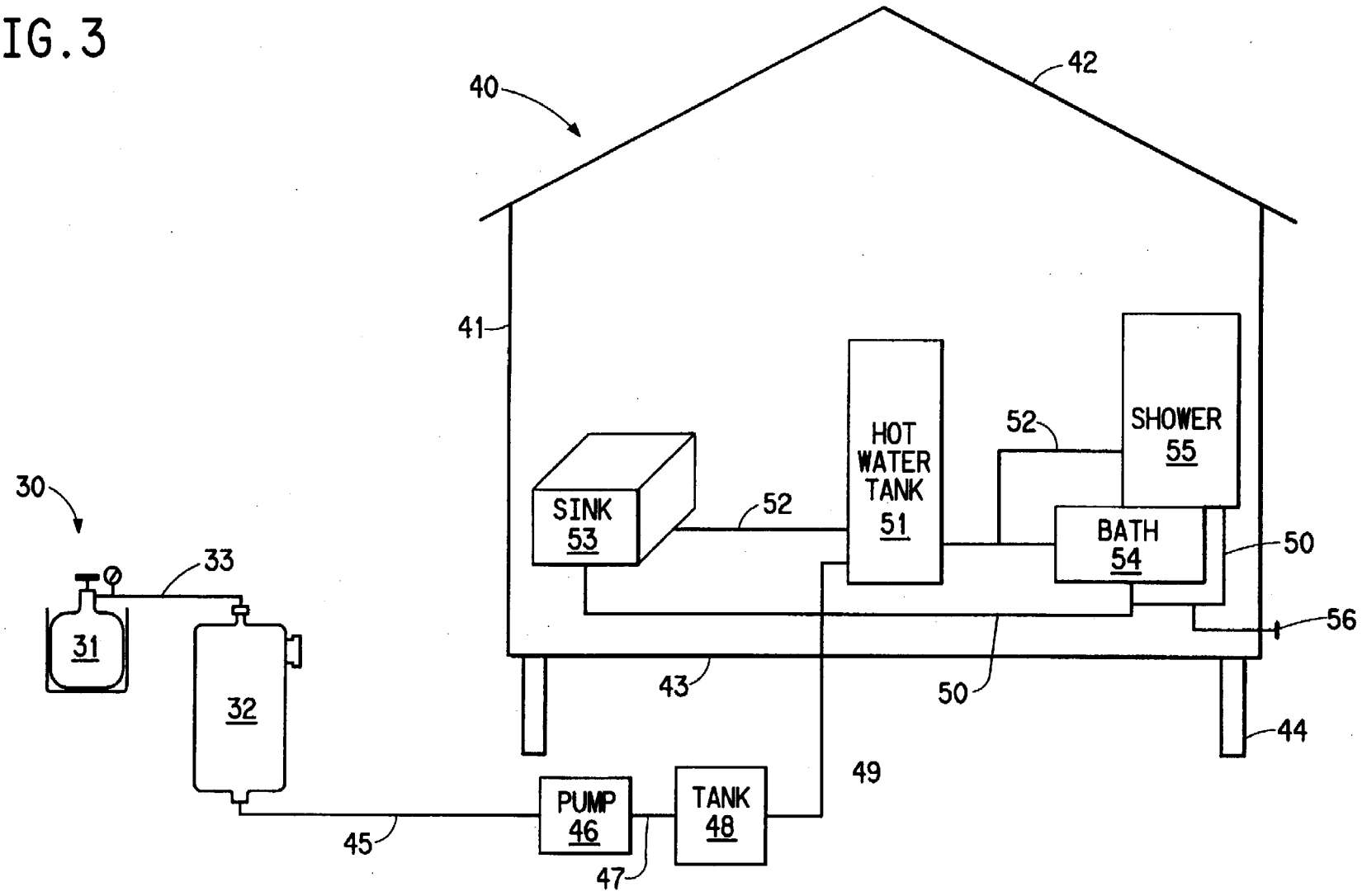
FIG. 3 is a schematic representation of a winterizing apparatus connected to a cottage.

FIG. 3 illustrates an embodiment of a winterizing apparatus 30 connected to a cottage 40. Winterizing apparatus 30 has an air tank 31 connected to fluid tank 32 by connecting hose 33.

Fluid tank 32 of FIG. 3 in connected by connecting hose 45 to water pump 46. Water pump 46 would normally be connected to a source of water, e.g. a lake or well or the like, during occupation of the cottage, and is utilized in the winterizing procedure. Water pump 46 may be at any convenient location, but is typically located beneath floor 43 of cottage 40, floor 43 being supported on supports 44 and spaced away from the ground. While FIG. 3 shows water pump 46 in an open environment, it is understood that water pump 46 would typically be enclosed in some manner, for protection, or even located in a basement area.

Cottage 40 is shown as having walls 41 and roof 42, and may be of any convenient shape, as will be understood. It is further understood that in other embodiments cottage 40 may be in the form of a trailer or other seasonal dwelling.

Water tank 48 is connected by connecting hose 49 to devices within the cottage. For instance, FIG. 3 shows connecting hose 49 as being connected by a cold water piping system 50, to kitchen sink 53, bath 54 and shower 55. In addition, connecting hose 49 is connected to hot water tank 51, which in turn is connected by hot water piping system 52 to kitchen sink 53, bath 54 and shower 55. It is understood that the cold water piping system 50 and/or the hot water piping system 52 may be connected to a variety of devices within the cottage, including kitchen sinks, bathroom sinks, baths, showers, toilets, outdoor taps 56 for watering of gardens or other uses and the like.

In use, the winterizing apparatus is conveniently transported in a form similar to that shown in FIG. 1, although, air pressure tank 2 would frequently be disconnected from fluid tank 10 during transportation, for ease in placing the winterizing apparatus in a vehicle and removal therefrom. Fluid outlet 12 is connected to a water inlet for cottage 40.

If the cottage is of the type that has a water inlet line running from a nearby lake, then the water inlet line would normally be pulled from the lake and disconnected, and fluid tank 10 connected thereto such that it was connected to the piping system within the cottage. Similarly, if the cottage was connected to a source of water, such as a well, or possibly even a municipal supply, fluid outlet 12 is connected to a suitable inlet. It is further understood that fluid outlet 12 could be connected at another location that might not normally be regarded as an inlet, e.g. an outdoor tap, but if so additional steps may need to be taken to winterize the water pump and water holding tank. Thus, it is preferred that fluid outlet 12 be connected into the means by which water enters the dwelling. A trailer or other seasonal dwelling could have similar sources of water.

With air pressure tank 2 connected to fluid tank 10, a pressure of air is established within elongated vessel 13 by opening of tank valve 3. It is likely that the pressure within air pressure tank 2 is substantially higher than the pressure that may be withstood by either elongated vessel 13 or the piping system within cottage 40. Thus, tank valve 3 would normally be opened to a predetermined controlled amount, and suitable pressure relief mechanisms may be provided within fluid tank 10 or associated apparatus to prevent the pressure rising above a predetermined amount. For instance, it may be desirable to restrict the pressure to not more than 20 psi, and especially not more than 15 psi by suitable pressure control means. It is preferred that such pressure control means be automatic i.e. activated as needed, rather than relying on an operator to control the pressure at below some predetermined level.

Winterizing apparatus has been tested using the following procedure. The apparatus substantially as shown in FIG. 1 had been constructed of polyvinyl chloride and tested to ensure that it would withstand more than the pressure that would be used in the winterizing process; it is believed that the apparatus could withstand about 150 psi, or more. The hose was disconnected from the main water source of the cottage or trailer that was being winterized. The hot water-tank was drained. The hose from the trailer was then connected to the winterizing apparatus with the other end of the winterizing apparatus being connected to a pressurized air tank. The pipes were then pressurized to a maximum pressure of 20 psi, to force water out of any water pipes, starting with the furthest tap from the winterizing apparatus. The procedure was repeated for each tap in the system, with air being blown through the opened tap until it was free of water. The winterizing apparatus was then disconnected and filled with antifreeze and the procedure was repeated, with each tap being opened until the antifreeze liquid passed from the opened tap. It was found that a trailer or a cottage could typically be winterized in less than 30 minutes, and the winterizing procedure could be handled by one person.

It is understood that during the winterizing process, electricity would be normally be disconnected from the water pump. Electricity would be disconnected from the hot water tank.

Many cottages and trailers have a water valve located at a low point in the piping system, which may be opened to drain water from the system. If so, such valve would normally be opened to allow as much water as possible to drain from the piping system. To do so, all taps within the cottage would normally be opened prior to winterizing the dwelling, but it is not necessary to do so. The method of the invention is then operated by closing all but one tap and applying air pressure from fluid tank 10. This will blow water within the piping system out the open tap. When air passes from the tap, the tap may be closed and another tap within the piping system opened. The procedure may be repeated as frequently as required, until all such taps have been opened and air passed therethrough. After an initial draining of the system, it may be convenient to open all taps within the system and apply some air to flush any last remaining amounts of water from the system.

Subsequently, tank valve 3 is turned off and a winterizing solution is added to fluid tank 10 through fluid inlet 14, i.e. by taking off the cap and pouring in an anti-freeze solution. The procedure for removal of water from the system is then repeated, with the operator watching to see if winterizing fluid passes from an open tap. When this occurs, the tap is closed and the operator continues to monitor other taps within the dwelling.

Apart from the possible removal of water from toilet tanks, toilet bowls and the septic tank pumping system, the method will have achieved winterizing of the cottage, trailer or other season dwelling in a very short period of time, and with considerable ease, especially compared with techniques typically used by owners of seasonal dwellings.

The ease in which a cottage or trailer may be winterized, according to the present invention, will be greatly appreciated by persons who own cottages and trailers. The winterizing of a cottage or trailer frequently takes several hours, and is often done in wet conditions and/or cold temperatures i.e. generally unpleasant conditions.

The winterizing apparatus described herein is very portable and can be used at any convenient location. The only apparatus required is the winterizing apparatus with a cylinder of compressed air, and the required antifreeze. There is no mixing of any solution required, as antifreeze is used as purchased. There are no mechanical parts to breakdown, which is a savings of both money and time over a period of years. The winterizing apparatus can be used on trailers and cottages and any other like building, and can be normally used to winterize the entire water system of such structures in 30 minutes or less.

We claim:

1. A method of winterizing a seasonal dwelling by replacement of water in a piping system within the dwelling with a winterizing fluid, said piping system having a water inlet, comprising:

(a) connecting said water inlet of said piping system of the dwelling to a fluid outlet valve of a portable fluid tank, said portable fluid tank having said fluid outlet valve at a first end thereof and a gas inlet located at a second end thereof opposed to said first end, said portable fluid tank having the gas inlet connected to a valved source of air under pressure;

(b) opening a first water outlet within said dwelling, passing air under pressure from said source of air under pressure through said portable fluid tank and from said fluid outlet thereof, through said water inlet and into the piping system until air passes from said first water outlet within said dwelling;

(c) repeating step (b) for each water outlet within said seasonal dwelling;

(d) ceasing the passing of air under pressure from said source of air and introducing winterizing fluid into said fluid tank;

(e) opening a first water outlet within said dwelling, passing further air under pressure from said source of air under pressure through said portable fluid tank and from said fluid outlet thereof, to force said winterizing fluid from said portable fluid tank into said water inlet until winterizing fluid passes from said water outlet; and (f) repeating step (e) for each water outlet within said seasonal dwelling.

2. The method of claim 1 in which the water outlets are closed in steps (b) and (e) after the respective fluid passes therefrom, before opening a water outlet in step (c) or step (d), respectively.

3. The method of claim 1 in which each water outlet remains open until all water has been removed from the piping system.

4. The method of claim 1 in which, in step (e), each water outlet is closed on detection of winterizing fluid passing from said water outlet.

5. The method of claim 1 in which the air pressure in said fluid tank is less than 20 psi.

6. The method of claim 5 in which said apparatus has a pressure relief valve.

7. The method of claim 1 in which the water outlet is a tap or valve.

* * * * *